US011071356B2

(12) United States Patent
Kolasa et al.

(10) Patent No.: US 11,071,356 B2
(45) Date of Patent: Jul. 27, 2021

(54) WEB-CONNECTING ASSEMBLY HAVING A RELEASE BUTTON

(71) Applicant: Illinois Tool Works Inc., Glenview, IL (US)

(72) Inventors: Scott D. Kolasa, Mt. Prospect, IL (US); Steven C. Keller, Island Lake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 10 days.

(21) Appl. No.: 16/256,530

(22) Filed: Jan. 24, 2019

(65) Prior Publication Data

US 2019/0150574 A1 May 23, 2019

Related U.S. Application Data

(63) Continuation of application No. 15/306,776, filed as application No. PCT/US2015/002759 on Mar. 26, 2015, now abandoned.

(60) Provisional application No. 61/988,967, filed on May 6, 2014.

(51) Int. Cl.

| | |
|---|---|
| ***A44B 11/26*** | (2006.01) |
| ***A44B 11/00*** | (2006.01) |
| ***A44B 11/25*** | (2006.01) |

(52) U.S. Cl.

CPC ..... *A44B 11/263* (2013.01); *A44B 11/006* (2013.01); *A44B 11/2596* (2013.01)

(58) Field of Classification Search

CPC ..... A44B 11/263; A44B 11/006; A44B 11/12; A44B 11/26; A44B 11/3424; D06F 81/02

See application file for complete search history.

(56) References Cited

U.S. PATENT DOCUMENTS

| | | | | |
|---|---|---|---|---|
| 5,471,716 A * | 12/1995 | Takahashi | A44B 11/263 24/615 |
| 5,548,879 A | 8/1996 | Wu | |
| 5,832,573 A * | 11/1998 | Howell | A44B 11/2526 24/664 |
| 5,842,256 A * | 12/1998 | Anscher | A44B 99/00 24/3.4 |
| 5,991,985 A | 11/1999 | Galbreath | |

(Continued)

FOREIGN PATENT DOCUMENTS

| | | | |
|---|---|---|---|
| EP | 0260959 A2 * | 3/1988 | A44B 11/26 |
| EP | 2627208 B1 | 7/2015 | |

*Primary Examiner* — Robert Sandy
*Assistant Examiner* — Matthew J Sullivan
(74) *Attorney, Agent, or Firm* — Quarles & Brady LLP

(57) ABSTRACT

A web-connecting assembly may include a connecting member and a securing member. The connecting member may include a connecting stud and a first web channel. The first web channel is configured to retain a first web. The securing member may include a housing defining a retaining chamber, a button pivotally secured to the housing, and a second web channel. The second web channel is configured to retain a second web. The button is configured to be moved between an open position in which a portion of the connecting stud is able to move into and out of the retaining chamber, and a closed position in which the button securely traps the portion of the connecting stud within the retaining chamber. The connecting member is securely connected to the securing member when the button securely traps the portion of the connecting stud within the retaining chamber.

20 Claims, 7 Drawing Sheets

(56) References Cited

U.S. PATENT DOCUMENTS

| | | | | |
|---|---|---|---|---|
| 6,138,330 | A | 10/2000 | Galbreath | |
| 6,161,266 | A * | 12/2000 | Anscher | A44B 11/266 24/625 |
| 6,678,925 | B1 | 1/2004 | Howell | |
| 6,725,506 | B1 * | 4/2004 | Anscher | A44B 99/00 24/170 |
| 9,072,344 | B2 * | 7/2015 | Yen | A44B 11/005 |
| 9,435,071 | B2 * | 9/2016 | Welsh, Jr. | D06F 81/02 |
| 9,730,496 | B1 * | 8/2017 | Moreau | A44B 13/0035 |
| 2011/0219590 | A1 * | 9/2011 | Anscher | A44B 11/266 24/606 |
| 2012/0102689 | A1 * | 5/2012 | Kung | A44B 11/263 24/636 |
| 2013/0192033 | A1 | 8/2013 | Hortnagl | |

* cited by examiner

WEB-CONNECTING ASSEMBLY HAVING A RELEASE BUTTON

RELATED APPLICATIONS

This application is a continuation of U.S. patent application Ser. No. 15/306,776, filed Oct. 26, 2016, which is a National Phase of International Application No. PCT/US2015/022759, filed Mar. 26, 2015, and relates to and claims priority benefits from U.S. Provisional Patent Application No. 61/988,967, filed May 6, 2014, each of which is hereby incorporated by reference in its entirety.

FIELD OF EMBODIMENTS OF THE DISCLOSURE

Embodiments of the present disclosure generally relate to a web-connecting assembly, and, more particularly, to a web-connecting assembly having a button that is configured to be engaged to release a separable components.

BACKGROUND

Buckles are used to securely connect components together. For example, various bags, backpacks, and the like have male and female buckle members connected to straps, webbing, or the like. Each strap, for example, is looped through a web channel on a buckle member. In order to connect the straps together, the male buckle member is connected to the female buckle member.

In various applications, web-retaining devices are used to secure straps or webs together. Known web-retaining devices include a hook that is configured to connect to another component. In general, the hook is long, particularly in relation to the other component to which it is configured to connect. Also, known web-retaining devices often include multiple joints or connections that are susceptible to breaking. Further, manipulating such devices to actuate gates to unhook the components may prove difficult for various individuals. As an example, an individual typically has to press a deflectable beam of the book inward and then remove a portion of another component within the hook while the beam is deflected inward. Also, the styling of known web-retaining devices may be considered outdated.

Accordingly, a need exists for a web-retaining device that is smaller, stronger, and easier to manipulate.

SUMMARY OF EMBODIMENTS OF THE DISCLOSURE

Certain embodiments of the present disclosure provide a web-connecting assembly that may include a connecting member and a securing member. The connecting member may include a connecting stud, and a first web channel. The first web channel is configured to retain a first web. The securing member may include a housing defining a retaining chamber, a button pivotally secured to the housing, and a second web channel. The second web channel is configured to retain a second web. The button is configured to be moved between an open position in which a portion of the connecting stud is able to move into and out of the retaining chamber, and a closed position in which the button securely traps the portion of the connecting stud within the retaining chamber. The connecting member is securely connected to the securing member when the button securely traps the portion of the connecting stud within the retaining chamber.

The connecting stud may include a stem connected to a distal head. The portion of the connecting stud may include the distal head. The head may include a circumferential base connected to a distal rim. The portion of the connecting stud may be configured to rotate relative to the retaining chamber when the connecting member is securely connected to the securing member.

The securing member may include opposed guide ramps that lead into the retaining chamber. The opposed guide ramps are configured to guide the portion of the connecting stud into the retaining chamber when the button is in the open position.

The button may be configured to be pivoted into the open position through movement of the portion of the connecting stud on the opposed guide ramps toward the retaining chamber. Alternatively, the button may be configured to be pivoted into the open only when engaged by an individual. The opposed guide ramps may connect to opposed ledges separated from a panel by a space. The portion of the connecting stud may be configured to be secured within the space when the connecting member is securely connected to the securing member.

The button may include one or more pivot arms that pivotally connect the button to the housing. The pivot arm(s) extend into the retaining chamber a distance that exceeds half a depth of the housing. The button may include a canted beam that is configured to urge the button into the closed position. The button may include a barrier lip that is configured to prevent the portion of the connecting stud from ejecting from the retaining chamber when the button is in the closed position.

The securing member may include a button-retaining pin that is configured to prevent the button from ejecting from the housing. The button-retaining pin may be initially connected to the housing through one or more flash connections. The button-retaining pin may be configured to be driven between portions of opposed pivot arms of the button.

Figure 1:
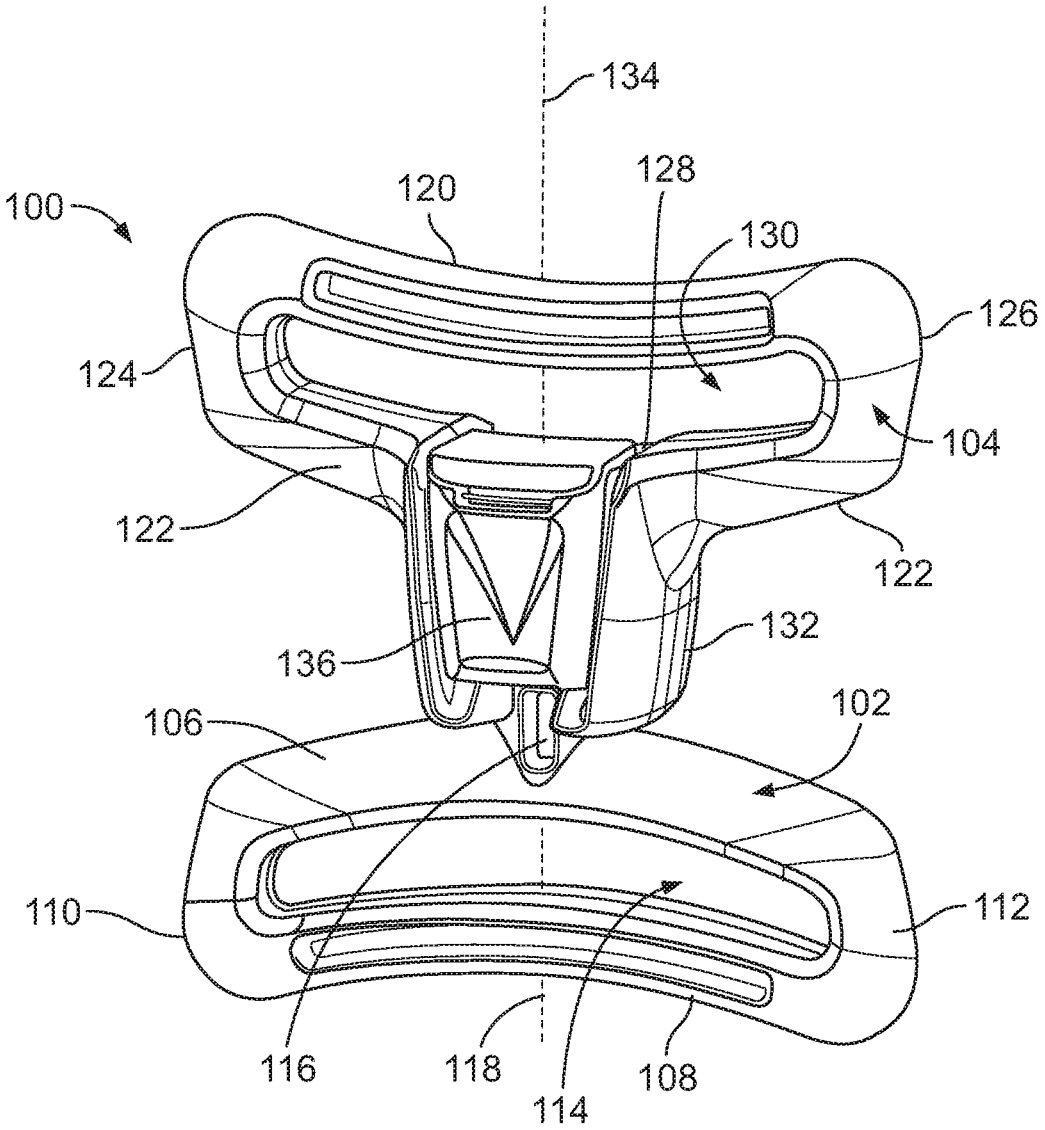
FIG. 1 illustrates a perspective front view of a web-connecting assembly in a connected state, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

FIG. 1 illustrates a perspective front view of a web-connecting assembly 100 in a connected state, according to an embodiment of the present disclosure. The web-connecting assembly 100 may include a first component or connecting member 102 (such as a male connecting web-retainer) that is configured to removably secure to second component or securing member 104 (such as a female securing web-retainer that receives and retains a portion of the male connecting web-retainer), or the like.

The connecting member 102 may include a first cross beam 106 connected to a second cross beam 108 through lateral struts 110 and 112. The cross beams 106 and 108 may generally be aligned with one another, such as being parallel to one another, while the struts 110 and 112 are generally aligned with one another, such as being parallel to one another and perpendicular to the cross beams 106 and 108. As shown, the cross beams 106, 108 and the struts 110, 112 may be curved or otherwise have arcuate portions. Alternatively, the cross beams 106, 108, and the struts 110, 112 may be straight, linear components. The cross beams 106, 108, and the struts 110, 112 define an internal web channel 114 that is configured to receive and retain webbing, such as a strap, belt, cord, rope, or the like.

A connecting stud 116, such as a post, column, tab, or other such protuberance, extends upwardly (as shown with respect to the orientation of the web-connecting assembly 100 in FIG. 1) from the cross beam 106. The connecting stud 116 may outwardly extend from the cross beam 106 about a central axis 118 of the connecting member 102. The central axis 118 may be a central lateral axis that bisects the connecting member 102 into two symmetrical halves. As such, the connecting stud 116 may be coaxial with the central axis 118.

The securing member 104 may include a cross beam 120 connected to opposed connecting beams 122 through lateral struts 124 and 126. The connecting beams 122 may connect to a central main body or housing 128. The cross beam 120 may generally be aligned with the connecting beams 122, such as being parallel thereto, while the struts 124 and 126 are generally aligned with one another, such as being parallel to one another and perpendicular to the cross beam 120 and the connecting beams 122. As shown, the cross beam 120, the connecting beams 122, and the struts 124, 126 may be curved or otherwise have arcuate portions. Alternatively, the cross beam 120, the connecting beams 122, and the struts 124, 126 may be straight, linear components. The cross beam 120, the connecting beams 122, the struts 124, 126, and the housing 128 define an internal web channel 130 that is configured to receive and retain webbing, such as a strap, belt, cord, rope, or the like.

The housing 128 may include a retaining shroud 132 that extends downwardly from the connecting beams 122 about a central axis 134 of the securing member 104. The central axis 134 may be a central lateral axis that bisects the securing member 104 into two symmetrical halves. In the connected position, the central axis 134 of the securing member 104 may be coaxial with the central axis 118 of the connecting member 102. A button 136 is pivotally secured to the retaining housing 132.

In operation, the button 136 is pivoted into an open position to expose a retaining chamber defined within the retaining shroud 132. For example, an individual may press an upper portion of the button 136 to pivot the button into an open position. When the button 136 is in the open position, at least a portion (such as a head) of the connecting stud 116 is moved into the retaining chamber and engaged in a secure position by one or more features within the retaining chamber. After the connecting stud 116 is securely positioned in the retaining chamber, the button 136 is pivoted back to a securing position, in which the button 136 securely traps the connecting stud 116 in the retaining chamber. In this manner, the connecting member 102 securely connects to the securing member 104.

Figure 2:
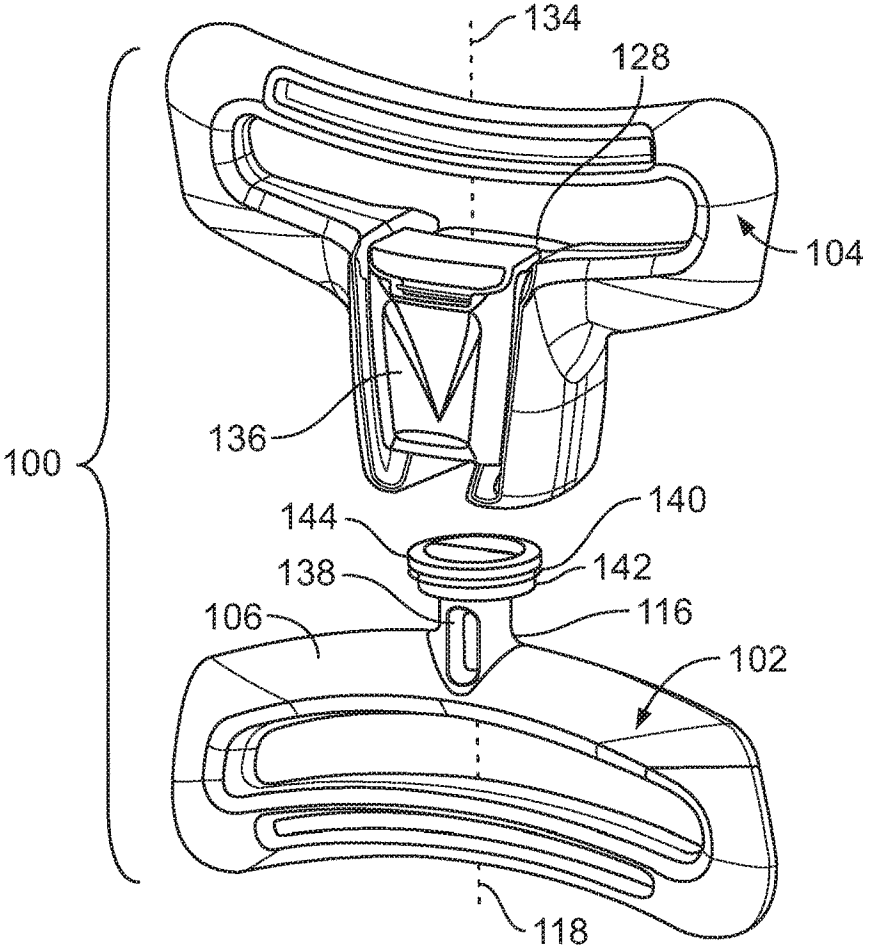
FIG. 2 illustrates a perspective front view of a web-connecting assembly in a disconnected state, according to an embodiment of the present disclosure.

FIG. 2 illustrates a perspective front view of the web-connecting assembly 100 in a disconnected state, according to an embodiment of the present disclosure. The connecting stud 116 of the connecting member 102 may include a stem 138 that extends from the cross beam 106 about the central axis 118. The stem 138 connects to a distal head 140 that includes a circumferential base 142 that connects to a distal rim 144 that radially extends from a distal portion of the base 142. The stem 138, the head 140, the base 142, and the rim 144 may have circular cross-sections, which allow the connecting stud 116 to rotate within the retaining chamber of the securing member 104 about the central axis 134 when the connecting member 102 is connected to the securing member 104.

Figure 3:
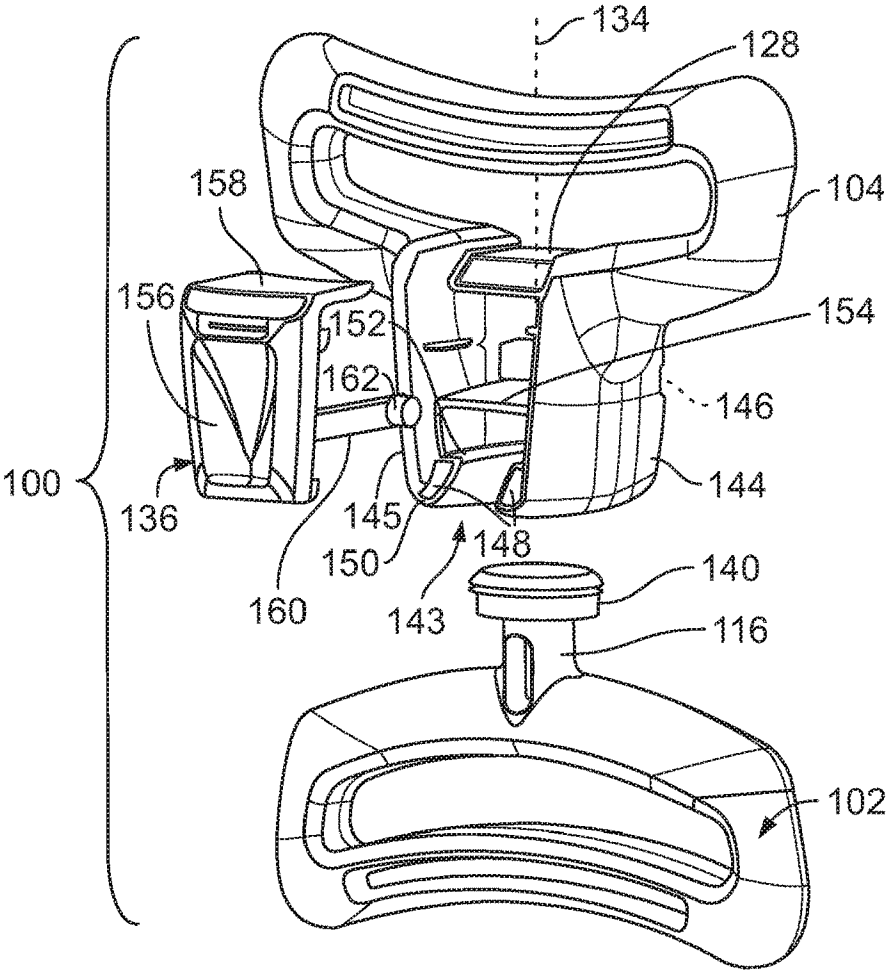
FIG. 3 illustrates a perspective front exploded view of a web-connecting assembly, according to an embodiment of the present disclosure.

FIG. 3 illustrates a perspective front exploded view of the web-connecting assembly 100, according to an embodiment of the present disclosure. As noted, the housing 128 of the securing member 104 includes a retaining chamber 143, which may be defined by lateral walls 145 and a rear wall 146. A guide ramp 148 inwardly extends into the retaining chamber 143 from each lateral wall 145. As shown, the guide ramps 148 oppose and mirror one another. The opposed guide ramps 148 are spaced apart from one another, thereby providing space for the stem 138 of the connecting stud 116 to pass therebetween. Each guide ramp 148 extends from a lower or distal front portion 150 of the housing 128 and angles upwardly toward the central axis 134. As shown, the guide ramps 148 may extend a relatively short distance into the retaining chamber 143, such that they do not extend into a central horizontal plane of the housing 128. The guide ramps 148 are configured to guide the connecting stud 116 of the connecting member 102 into the retaining chamber 143.

The guide ramps 148 connect to opposed ledges 152 that may reside in a plane that is perpendicular to the central axis 134. The opposed ledges are spaced apart from one another, thereby providing space for the stein 138 of the connecting stud 116 to pass therebetween. A flat panel 154 may extend between the lateral walls 145 within the retaining chamber and is separated from the ledges 152 a vertical distance that allows the head 140 of the connecting stud 116 to be securely retained therein. The flat panel 154 may reside in a plane that is parallel to the plane in which the ledges 152 reside.

The button 136 includes an outer engageable face 156 that connects to an upper panel 158, which may be perpendicular to the face 156. One or more pivot arms 160 extend inwardly into the retaining chamber 143 from an interior surface of the face 156. A pivot joint 162, such as a cylindrical bearing, extends from a distal end of the pivot arm 160 and is configured to pivotally retain a reciprocal structure (such as a cylindrical post that fits into a central opening of the pivot joint 162, or a reciprocal recessed area that receives and retains the pivot joint 162) that inwardly extends from one or both of the lateral walls 145. The pivot arm(s) 160 are configured to allow the button 136 to be pivoted between open and closed positions with respect to the housing 128. The pivot arm(s) 160 may extend further away from the face 156 than the upper panel 158. That is, the pivot arm(s) 160 may be longer than the upper panel 158.

Figure 4:
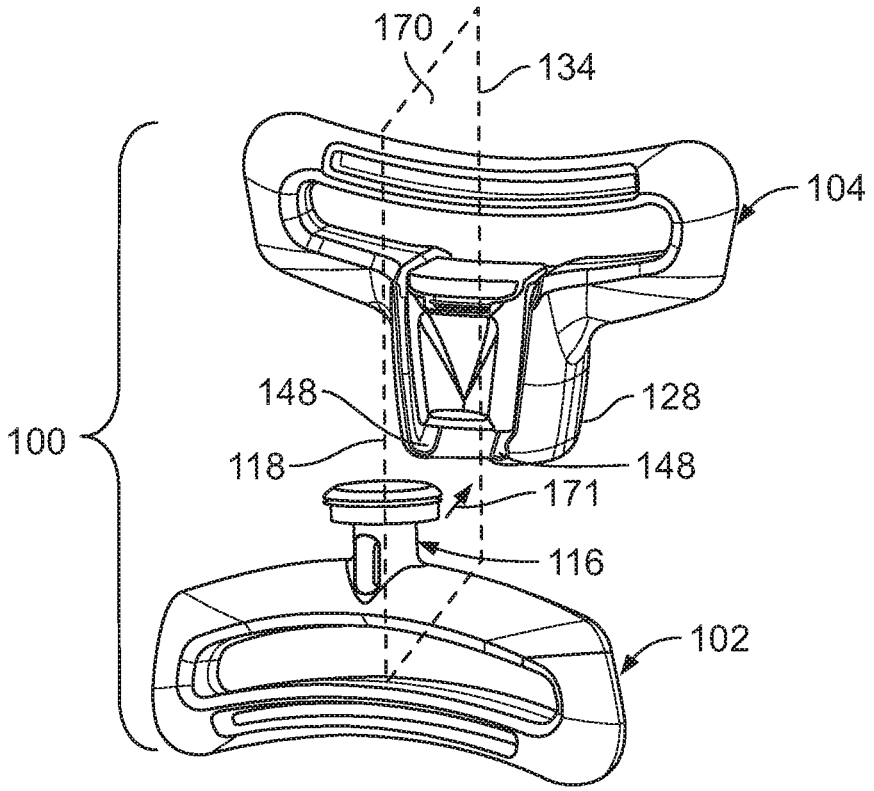
FIG. 4 illustrates a perspective front view of a web-connecting assembly in a disconnected state in which a connecting member is in an initial aligned position with respect to a securing member, according to an embodiment of the present disclosure.

FIG. 4 illustrates a perspective front view of the web-connecting assembly 100 in a disconnected state in which the connecting member 102 is in an initial aligned position with respect to the securing member 104, according to an embodiment of the present disclosure. In order to connect the connecting member 102 to the securing member 104, the connecting stud 116 of the connecting member 102 is positioned in front and below the housing 128 of the securing member 104 such that the central axis 118 of the connecting member 102 and the central axis 134 of the securing member are within a common plane 170 that is coplanar with central orthogonal planes of the connecting member 102 and the securing member 104. Then, the connecting member 102 is urged toward the securing member 104 in the direction of arrow 171 such that the connecting stud 116 engages the ramps 148 of the housing 128.

Figure 5:
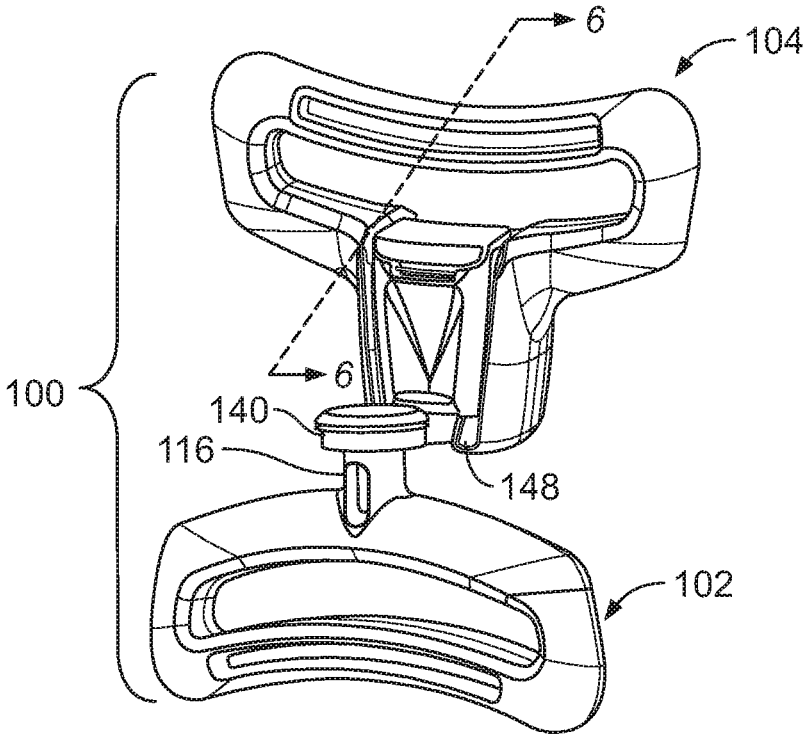
FIG. 5 illustrates a perspective front view of a web-connecting assembly in which a connecting member initially engages a portion of a securing member, according to an embodiment of the present disclosure.

FIG. 5 illustrates a perspective front view of the web-connecting assembly 100 in which the connecting member 102 initially engages a portion of the securing member 104, according to an embodiment of the present disclosure. As shown, the connecting stud 116 engages the ramps 148, such that bottom edge portions of the base 142 overlay the ramps 148.

Figure 6:
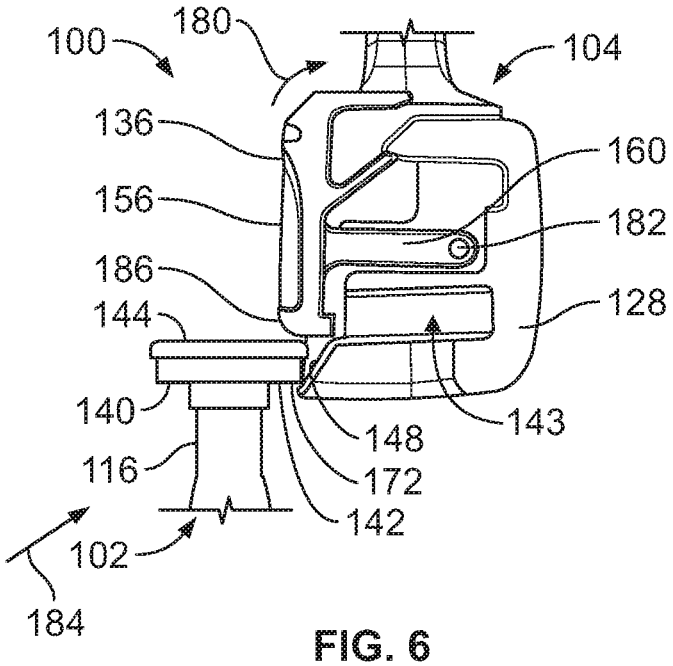
FIG. 6 illustrates a lateral axial cross-sectional view of a web-connecting assembly through line 6-6 of FIG. 5, according to an embodiment of the present disclosure.

FIG. 6 illustrates a lateral axial cross-sectional view of the web-connecting assembly 100 through line 6-6 of FIG. 5, according to an embodiment of the present disclosure. As shown, a bottom edge portion 172 of the base 142 of the connecting stud 116 may be positioned on the ramps 148 that lead into the retaining chamber 143. In order to position the connecting stud 116 within the retaining chamber 143, the face 156 of the button 136 may be engaged (for example, pressed) to pivot the button 136 open about a pivot axis 182 defined by the interface of the pivot arm 160 and the reciprocal portion(s) of the housing 128.

Optionally, an individual may not need to directly engage the button 136 in order to expose the retaining chamber 143. Instead, as the connecting stud 116 is urged into the retaining chamber 143 over the ramps 148 (which guide the connecting stud 116 toward and into the retaining chamber 143) in the direction of arrow 184, the head 140 of the cylindrical stud 116 abuts into a lower edge 186 of the button 136 and forces the button 136 to pivot open in the direction of arc 180, as the connecting stud 116 continues to be urged in the direction of arrow 184.

Figure 7:
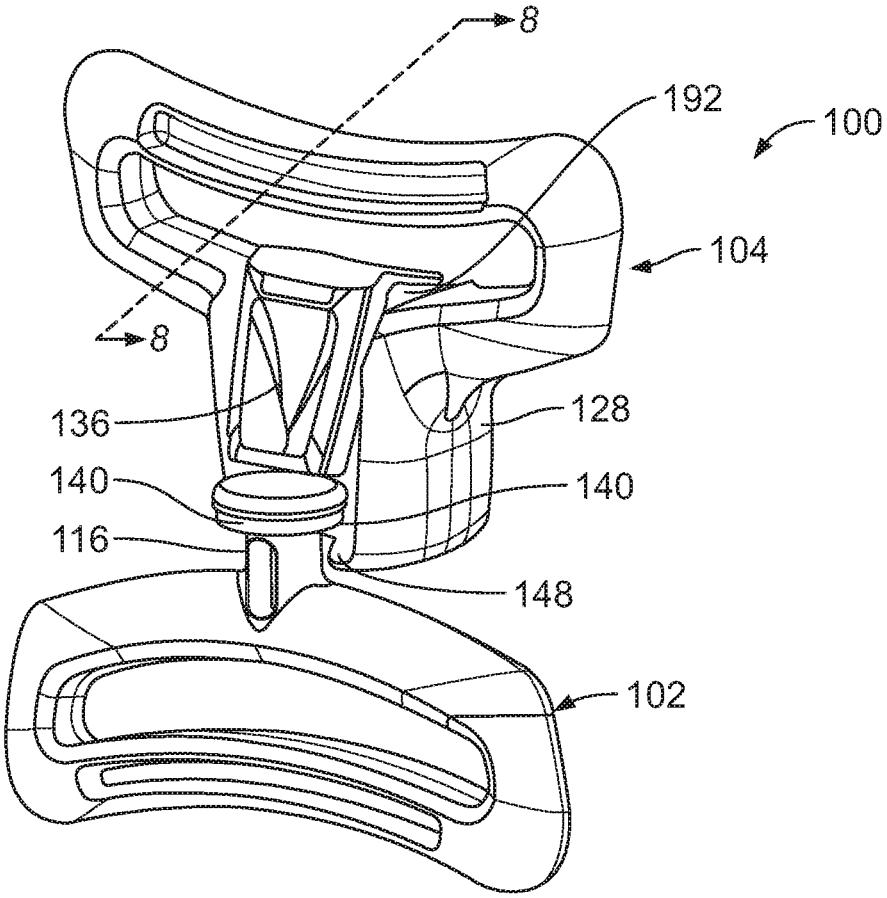
FIG. 7 illustrates a perspective front view of a web-connecting assembly in which a connecting stud of a connecting member pivots a button of a securing member into an open position, according to an embodiment of the present disclosure.
Figure 8:
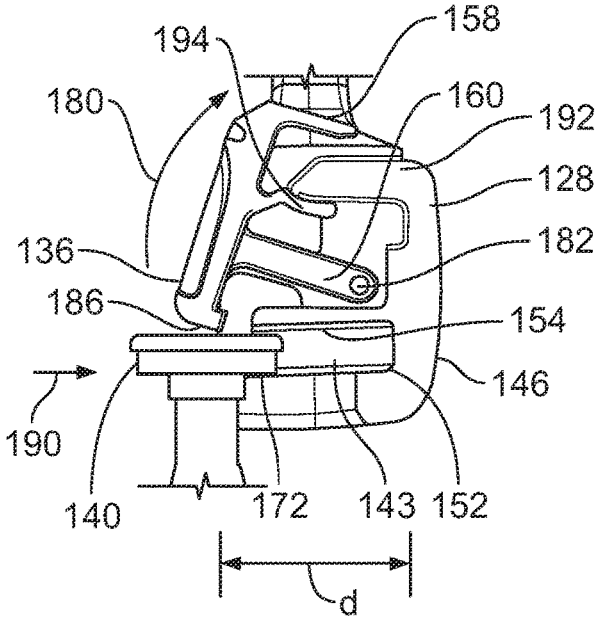
FIG. 8 illustrates a lateral axial cross-sectional view of a web-connecting assembly through line 8-8 of FIG. 7, according to an embodiment of the present disclosure.

FIG. 7 illustrates a perspective front view of a web-connecting assembly in which the connecting stud 116 of the connecting member 102 pivots the button 136 of the securing member 104 into an open position, according to an embodiment of the present disclosure. FIG. 8 illustrates a lateral axial cross-sectional view of the web-connecting assembly 100 through line 8-8 of FIG. 7. Referring to FIGS. 7 and 8, after the connecting stud 116 slides into the retaining chamber 143 over the ramps 148, the bottom edge portion 172 of the head 140 slides onto the ledges 152. As shown, the lower edge 186 of the button 136 abuts into a top of the head 140. The pivot arm 160 is pivoted open in the direction of arc 180, thereby allowing the head 140 to be moved into the space between the ledges 152 and the flat panel 154 in the direction of arrow 190. During the pivotal motion of the button 136, the top panel 158 may pivot over a top wall 192 of the housing 128, while an upwardly canted beam 194 of the button 136 deflects downwardly against an interior surface of the top wall 192. After the button 136 no longer engages the top of the connecting stud 116, the canted beam 194 springs back to its at-rest position, thereby providing a force that returns the button 136 to a closed position.

In order to securely connect the connecting member 102 to the securing member 104, the securing member continues to be urged into retaining chamber 143 in the space between the ledges 152 and the panel 154 until the head 140 abuts into the rear wall 146 of the housing 128, thereby positioning the head 140 on the ledges 152 in a secure seated position. In this position, the lower edge 186 of the button 136 no longer contacts the top of the head 140. As such, the button 136 pivots back to its at-rest position (such as by the canted beam 194 forcing the button 136 back to the closed position), thereby trapping the head 140 within the retaining chamber 143, which in turn securely connects the connecting member 102 to the securing member 104.

As shown, the pivot arm 160 extends deep into the retaining chamber 143 proximate to the rear wall 146 of the housing 128. For example, the length of the pivot arm 160 may exceed half the depth d of the housing 128. In at least one embodiment, the length of the pivot arm 160 exceeds 0.75 d. Alternatively, the length of the pivot arm 160 may be greater or lesser than 0.75 d. In this manner, the pivot arm 160 is long enough to provide an opening between the button 136 and the housing 128 of sufficient clearance to allow the head 140 of the connecting stud 116 to pass therethrough.

Figure 9:
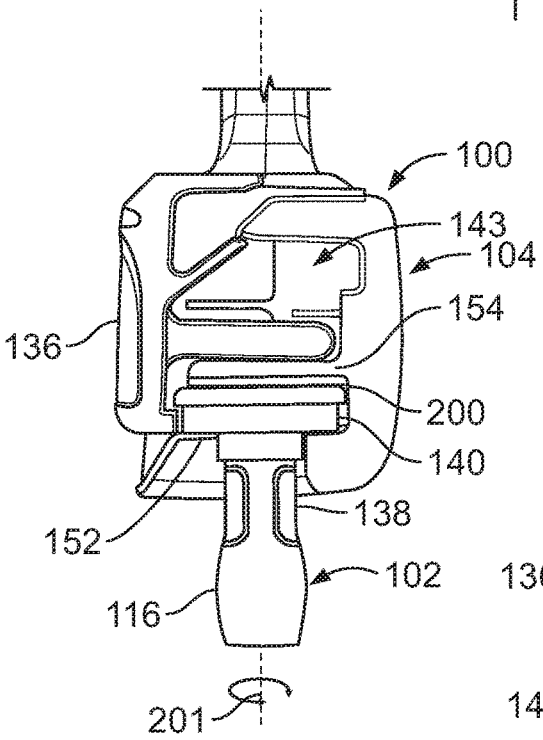
FIG. 9 illustrates a lateral axial cross-sectional view of a web-connecting assembly in a secure connected state, according to an embodiment of the present disclosure.

FIG. 9 illustrates a lateral axial cross-sectional view of the web-connecting assembly 100 in a secure connected state, according to an embodiment of the present disclosure. As shown, the head 140 is securely retained within a space 200 between the ledges 152 and the panel 140. The button 136 traps the head 140 of the connecting stud 116 within the retaining chamber 143.

Because the head 140 includes a circular cross-section and the stem 138 also includes a circular cross-section, the connecting member 102 may rotate relative to the securing member 104 (or vice versa) about a central axis 201 (which may be a coaxial combination of the axes 118 and 134 of the connecting member 102 and the securing member 104, respectively) of the assembly 100. The ability of the connecting member 102 and the securing member 104 to rotate in such a manner provides the assembly 100 with the ability to adapt to various connection orientations and movements, for example. Alternatively, the connecting stud 116 may include other cross-sections that prevent rotation or allow limited rotation between the connecting member 102 and the securing member 104.

Figure 10:
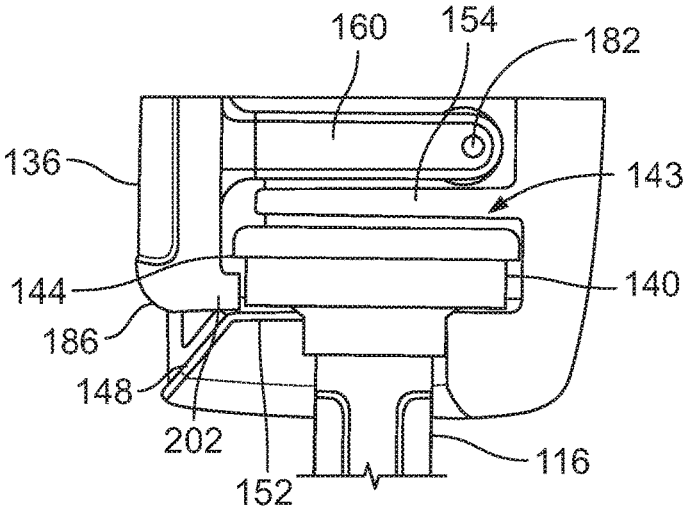
FIG. 10 illustrates a lateral axial cross-sectional view of a connecting stud trapped within a retaining chamber of the housing of a securing member, according to an embodiment of the present disclosure.

FIG. 10 illustrates a lateral axial cross-sectional view of the connecting stud 116 trapped within the retaining chamber 143 of the housing of the securing member 104, according to an embodiment of the present disclosure. A barrier lip 202 extends inwardly from the lower edge 186 of the button 136. The barrier lip 202 is disposed below the rim 144 of the head 140 of the connecting stud 116. The barrier lip 202 is configured to prevent the connecting stud 116 from ejecting from the retaining chamber 143, unless the button 136 is engaged into an open position.

Figure 11:
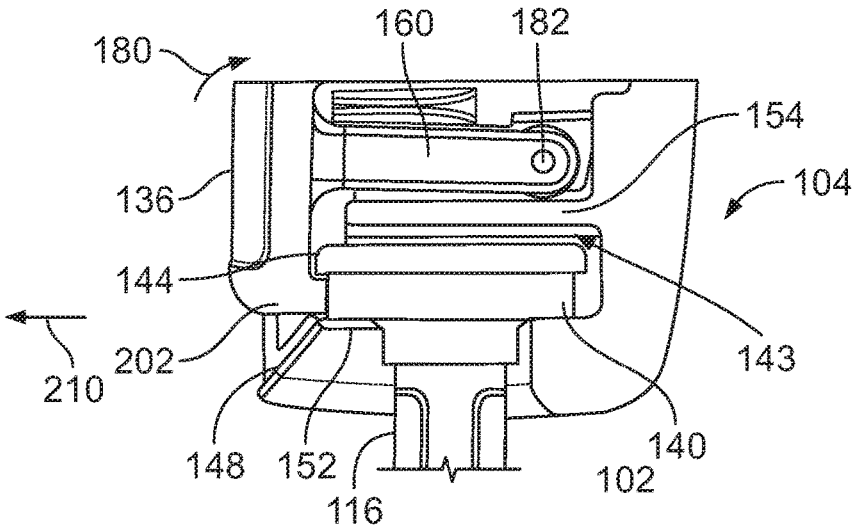
FIG. 11 illustrates a lateral axial cross-sectional view of a button of a securing member preventing a connecting stud from ejecting from a retaining chamber, according to an embodiment of the present disclosure.

FIG. 11 illustrates a lateral axial cross-sectional view of the button 136 of the securing member 104 preventing the connecting stud 116 from ejecting from the retaining chamber 143, according to an embodiment of the present disclosure. When the head 140 shifts within the retaining chamber towards an ejection in the direction of arrow 210, the rim 144 of the head 140 latches onto the barrier lip 202, thereby preventing the button 136 from pivoting into an open position.

In order to remove the head 140 from the retaining chamber 143 (and disconnect the connecting member 102 from the securing member 104), the button 136 is engaged so that the pivot arm 160 pivots about the pivot axis 182, thereby removing the barrier lip 202 from the rim 144, and providing a path of sufficient clearance to allow the head 140 to be removed from the retaining chamber 143. Once the path of sufficient clearance is formed by way of the button 136 pivoting to the open position, the connecting member 102 may be disconnected from the securing member 104 in the direction of arrow 210.

The button 136 provides a pivoting release. The button 136 is pivotally secured to the housing 128 through one or more pivot arms 160 that allow the release button 136 to pivot over an arc. The length of the pivot arm 160 allows the button 136 to pivot open (thereby providing a path through which the head 140 may pass) and close. The relatively long pivot arm 160 allows for an opening of sufficient size to allow the head 140 to enter and exit the retaining chamber 143. As noted above, the button 136 may include more than one pivot arm 160.

Embodiments of the present disclosure provide a locking geometry that protects against inadvertent separation of the connecting member 102 from the securing member 104. The locking interfaces and interaction between the head 140 and the button 136 ensures that the head 140 remains secured within the retaining chamber 143 until the button 136 is engaged by an individual into an open position. As shown in FIG. 11, if the head 140 shifts outward, it latches onto the button 136, thereby ensuring that the head 140 remains within the retaining chamber 143.

Figure 12:
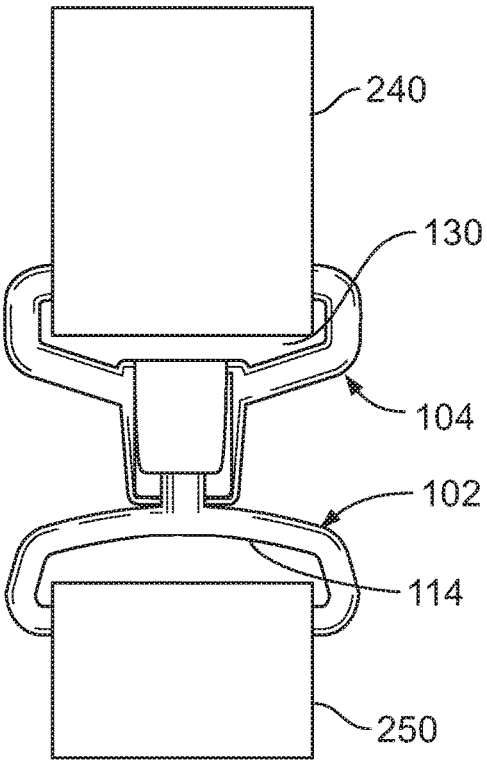
FIG. 12 illustrates a front view of a web-connecting member connected to webs, according to an embodiment of the present disclosure.

FIG. 12 illustrates a front view of the web-connecting member 100 connected to webs 240 and 250, according to an embodiment of the present disclosure. As shown, the web 240 is retained within the web channel 130 of the securing member 104, while the web 250 is retained with the web channel 114 of the connecting member 102.

Figure 13:
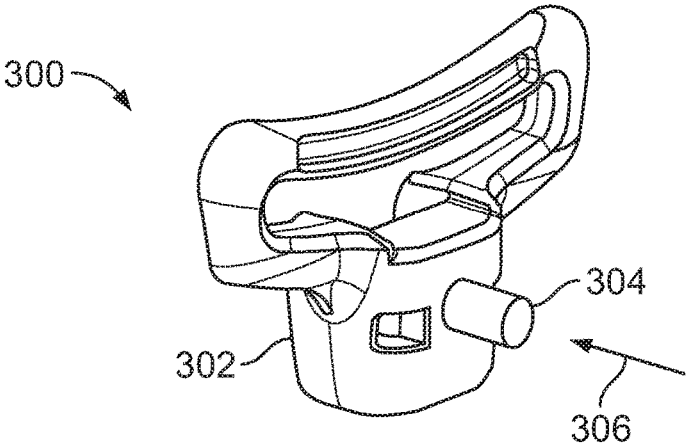
FIG. 13 illustrates a perspective rear view of a securing member, according to an embodiment of the present disclosure.

FIG. 13 illustrates a perspective rear view of a securing member 300, according to an embodiment of the present disclosure. The securing member includes a housing 302 similar to those described above. A button-retaining pin 304 is molded onto the housing 302, such as through a thin layer of material. For example, the button-retaining pin 304 may be secured through one or more flash connections of plastic that are configured to break when the button-retaining pin 304 is urged inwardly into a retaining chamber in the direction of arrow 306.

Figure 14:
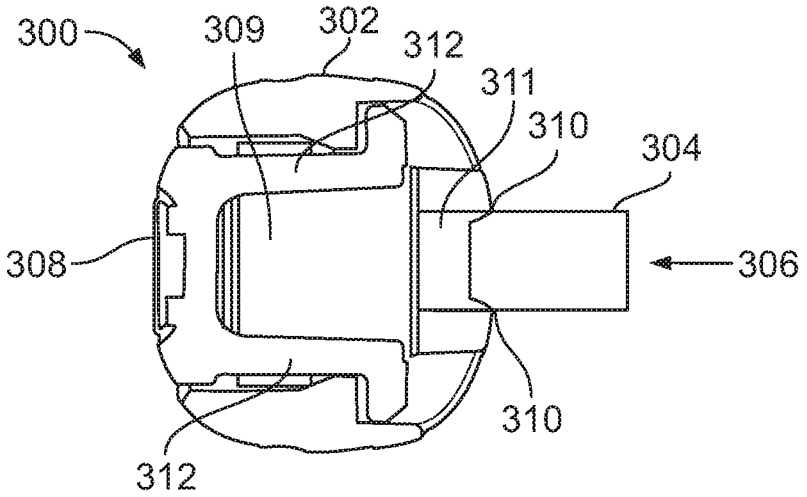
FIG. 14 illustrates an internal cross-sectional view of a securing member having a button positioned within a retaining chamber, according to an embodiment of the present disclosure.

FIG. 14 illustrates an internal cross-sectional view of the securing member 300 having a button 308 positioned within a retaining chamber 309, according to an embodiment of the present disclosure. As shown, in an initial position, the pin 304 is secured within a drive channel 311 through flash connections 310. The button 308 includes opposed pivot arms 312, similar to the pivot arm(s) 160 described above. After the button 308 is positioned within the retaining chamber 309, the pin 304 is driven into the retaining chamber 309 (thereby breaking the flash connections 310) through the drive channel 311 so that the pin 304 is positioned between the opposed pivot arms 312.

Figure 15:
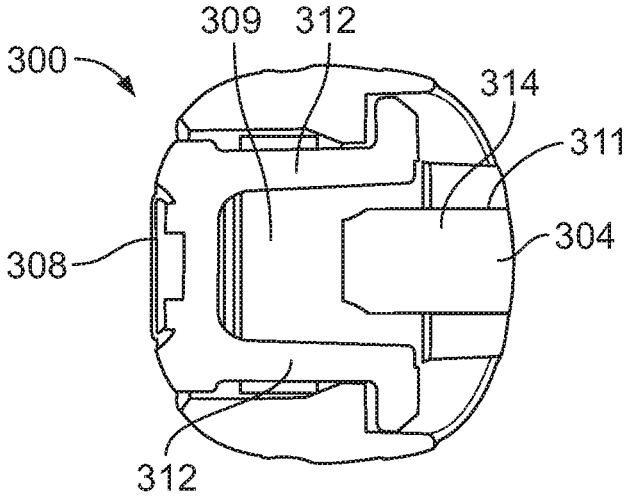
FIG. 15 illustrates an internal cross-sectional view of a securing member having a button positioned within a retaining chamber with a button-retaining pin driven between opposed pivot arms of the button, according to an embodiment of the present disclosure.

FIG. 15 illustrates an internal cross-sectional view of the securing member 300 having the button 308 positioned within the retaining chamber 309 with the button-retaining pin 304 driven between the opposed pivot arms 312 of the button 308, according to an embodiment of the present disclosure. As shown, the pin 304 remains radially secured within the drive channel 311, with a distal end 314 positioned between portions of the pivot arms 312.

Figure 16:
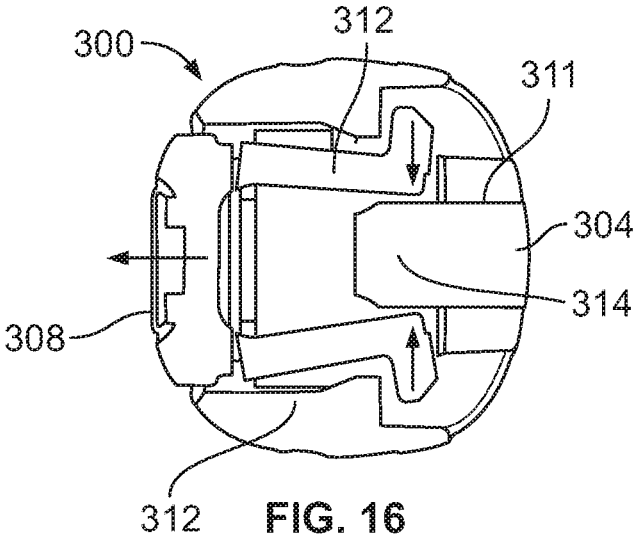
FIG. 16 illustrates an internal cross-sectional view of a securing member having a button positioned within a retaining chamber with opposed pivot arms collapsing on a button-retaining pin, according to an embodiment of the present disclosure.

FIG. 16 illustrates an internal cross-sectional view of the securing member 300 having the button 308 positioned within the retaining chamber 309 with opposed pivot arms 312 collapsing on the button-retaining pin 304, according to an embodiment of the present disclosure. When the button 308 is subjected to a force that squeezes the pivot arms 312 toward one another, interior surfaces of the pivot arms 312 contact the distal end 314 of the pin 304. As such, the distal end 314 is sandwiched between the opposed pivot arms 312. In this manner, the pin 304 limits the distance over which the pivot arms 312 may inwardly flex, which ensures that the button 308 does not eject from the securing member 300.

The pin 304 may be used with any of the embodiments of the present disclosure. For example, with respect to FIGS. 1-12, the securing member 104 may include a pin that is driven between opposed pivot arms 160 in order to ensure that the button 136 remains secured to the housing 128.

Embodiments of the present disclosure provide web-connecting assemblies that are shorter than known hooking devices. In comparison to known hooking devices, embodiments of the present disclosure provide web-connecting assemblies that are shorter, stronger, and easier to manipulate. The short, compact length of the web-connecting assemblies is realized by using a connecting stud that secures into a retaining chamber, for example, instead of a hook component.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

The invention claimed is:

1. A web-connecting assembly, comprising:

a connecting member including:

a connecting stud; and a first web channel, wherein the first web channel is configured to retain a first web; and a securing member including:

a housing defining a retaining chamber;

a button pivotally secured to the housing, wherein the button comprises a canted beam; and a second web channel, wherein the second web channel is configured to retain a second web, wherein the button is moveable between an open position in which a portion of the connecting stud is able to move into and out of the retaining chamber, and a closed position in which the button securely traps the portion of the connecting stud within the retaining chamber, wherein the canted beam is urged against an inner wall of the housing when the button is moved to the open position, wherein the canted beam biases the button into the closed position, and wherein the connecting member is securely connected to the securing member when the button securely traps the portion of the connecting stud within the retaining chamber.

2. The web-connecting assembly of claim 1, wherein the securing member further includes a button-retaining pin that is configured to prevent the button from ejecting from the housing, wherein the button-retaining pin is initially connected to the housing through one or more flash connections, and wherein the button-retaining pin is configured to be driven between portions of opposed pivot arms of the button.

3. The web-connecting assembly of claim 1, wherein the connecting stud comprises a stem connected to a distal head, wherein the portion of the connecting stud includes the distal head.

4. The web-connecting assembly of claim 3, wherein the distal head comprises a circumferential base connected to a distal rim.

5. The web-connecting assembly of claim 1, wherein the portion of the connecting stud is configured to rotate relative to the retaining chamber when the connecting member is securely connected to the securing member.

6. The web-connecting assembly of claim 1, further comprising opposed guide ramps that lead into the retaining chamber, wherein the opposed guide ramps are configured to guide the portion of the connecting stud into the retaining chamber when the button is in the open position.

7. The web-connecting assembly of claim 6, wherein the button is configured to be pivoted into the open position through movement of the portion of the connecting stud on the opposed guide ramps toward the retaining chamber.

8. The web-connecting assembly of claim 6, wherein the opposed guide ramps connect to opposed ledges separated from a panel by a space, wherein the portion of the connecting stud is configured to be secured within the space when the connecting member is securely connected to the securing member.

9. The web-connecting assembly of claim 1, wherein the button comprises one or more pivot arms that pivotally connect the button to the housing, wherein the one or more pivot arms extend into the retaining chamber a distance that exceeds half a depth of the housing.

10. The web-connecting assembly of claim 1, wherein the button comprises a barrier lip that is configured to prevent the portion of the connecting stud from ejecting from the retaining chamber when the button is in the closed position.

11. A web-connecting assembly configured to retain one or more webs, the web-connecting assembly comprising:

a connecting member including a connecting stud; and a securing member including:

a housing defining a retaining chamber;

a button pivotally secured to the housing, wherein the button comprises a canted beam, wherein the button is configured to be moved between an open position in which a portion of the connecting stud is able to move into and out of the retaining chamber and a closed position in which the button securely traps the portion of the connecting stud within the retaining chamber, wherein the canted beam is urged against an inner wall of the housing when the button is moved to the open position, and wherein the canted beam biases the button into the closed position.

12. The web-connecting assembly of claim 11, wherein the securing member further comprises a button-retaining pin that is configured to prevent the button from ejecting from the housing, wherein the button-retaining pin is initially connected to the housing through one or more flash connections, and wherein the button-retaining pin is configured to be driven between portions of opposed pivot arms of the button.

13. A web-connecting method configured to retain one or more webs, the web-connecting method comprising:

providing a connecting member including a connecting stud; and providing a securing member including a housing defining a retaining chamber, and a button pivotally secured to the housing, wherein the button comprises a canted beam; and moving the button from the closed position to the open position to engage the canted beam with an inner wall of the housing, thereby deforming the canted beam and providing a biasing force on the button that biases the button toward the closed position.

14. The web-connecting method of claim 13, wherein the moving comprises moving the button between the open position in which a portion of the connecting stud is able to move into and out of the retaining chamber, and the closed position in which the button securely traps the portion of the connecting stud within the retaining chamber.

15. The web-connecting method of claim 13, wherein the moving comprises urging the canted beam against an inner wall of the housing when the button is moved to the open position.

16. The web-connecting method of claim 15, wherein the moving further comprises biasing the button with the canted beam into the closed position.

17. The web-connecting method of claim 13, further comprising:

providing the securing with a button-retaining pin;

initially connecting the button-retaining pin to the housing through one or more flash connections;

driving the button-retaining pin between portions of opposed pivot arms of the button; and preventing, by the button-retaining pin, the button from ejecting from the housing.

18. A web-connecting assembly, comprising:

a connecting member including:

a connecting stud including a stem connected to a distal head, wherein the distal head comprises a circumferential base connected to a distal rim; and a first web channel, wherein the first web channel is configured to retain a first web; and a securing member including:

a housing defining a retaining chamber;

opposed guide ramps that lead into the retaining chamber, wherein the opposed guide ramps connect to opposed ledges separated from a panel by a space;

a button pivotally secured to the housing, wherein the button comprises a canted beam, a barrier lip, and one or more pivot arms that pivotally connect the button to the housing, wherein the one or more pivot arms extend into the retaining chamber a distance that exceeds half a depth of the housing; and a second web channel, wherein the second web channel is configured to retain a second web, wherein the button is moveable between an open position in which the distal head is able to move into and out of the retaining chamber, and a closed position in which the button securely traps the distal head within the retaining chamber, wherein the opposed guide ramps are configured to guide the distal head into the retaining chamber when the button is in the open position, wherein the canted beam is urged against an inner wall of the housing when the button is moved to the open position, wherein the button is configured to be pivoted into the open position through movement of the distal head on the opposed guide ramps toward the retaining chamber, wherein the canted beam biases the button into the closed position, wherein the connecting member is securely connected to the securing member when the button securely traps the distal head within the retaining chamber, wherein the barrier lip is configured to prevent distal head from ejecting from the retaining chamber when the button is in the closed position, wherein the distal head is configured to be secured within the space when the connecting member is securely connected to the securing member, and wherein the distal head is configured to rotate relative to the retaining chamber when the connecting member is securely connected to the securing member.

19. The web-connecting assembly of claim 18, wherein the securing member further includes a button-retaining pin that is configured to prevent the button from ejecting from the housing, wherein the button-retaining pin is initially connected to the housing through one or more flash connections, and wherein the button-retaining pin is configured to be driven between portions of opposed pivot arms of the button.

20. The web-connecting assembly of claim 11, wherein when the button is pivoted from the closed position to the open position, the canted beam engages an inner wall of the housing and deforms to provide a biasing force on the button that biases the button toward the closed position.

* * * * *